US005199185A

United States Patent [19]

Davidson

[11] Patent Number: 5,199,185

[45] Date of Patent: Apr. 6, 1993

[54] PROCESS AND EQUIPMENT FOR GASEOUS DESICCATION OF ORGANIC PARTICLES

[75] Inventor: James G. Davidson, Paris, Tenn.

[73] Assignee: Western Dry, Inc., Marion, Ill.

[21] Appl. No.: 719,121

[22] Filed: Jun. 20, 1991

[51] Int. Cl.[5] ..... F26B 7/00

[52] U.S. Cl. ..... 34/12; 34/36; 34/22; 34/60; 34/80; 34/147; 361/233

[58] Field of Search ..... 34/1 A, 1 C, 9, 17, 34/36, 12, 80, 10, 57 E, 147, 22, 60–61; 361/226, 233

[56] References Cited

U.S. PATENT DOCUMENTS

| | | | |
|---|---|---|---|
| 3,327,402 | 6/1967 | Lamb et al. | 34/9 |
| 3,953,927 | 5/1976 | Hoffert | 34/9 |
| 4,339,882 | 7/1982 | Dickey et al. | 34/9 |
| 4,395,334 | 7/1983 | Nakabayashi et al. | 34/12 |
| 4,459,762 | 7/1984 | Hardesty et al. | 34/9 |
| 4,486,959 | 12/1984 | Chang | 34/9 |
| 4,628,619 | 12/1986 | Janusch et al. | 34/180 |
| 4,686,775 | 8/1987 | Vauk | 34/9 |

*Primary Examiner*—Henry A. Bennet
*Assistant Examiner*—Denise L. F. Gromada
*Attorney, Agent, or Firm*—Waters & Morse

[57] ABSTRACT

A process for removing moisture from coal comprises transforming the coal to coal fines, polarizing the coal fines to produce an electrical charge differential between the relatively non-conductive water and the relatively conductive coal particles, and removing the water by admixing the coal fines in a drying chamber with a dry gaseous mixture having a different electrical state from the moisture, such that the moisture is selectively attracted to the gaseous media, and then separating the moisture laden gaseous media from the coal fines and collecting the fines. The admixture is accomplished with a vertically oriented cylindrical drying chamber wherein the fines are introduced at the top of the chamber and settle downwardly and the dry, gaseous media is directed upwardly through the chamber in a swirling helical path. The helical path is induced by a series of stepped radial baffle plates spaced along the chamber in the fashion of a spiral staircase, with the gaseous media being introduced through nozzles positioned adjacent the plates. The gaseous media can be dried for reuse in the system after it is removed from the top of the chamber.

39 Claims, 6 Drawing Sheets

PROCESS AND EQUIPMENT FOR GASEOUS DESICCATION OF ORGANIC PARTICLES

BACKGROUND OF THE INVENTION

This invention relates generally to processes and equipment for the removal of water from coal fines and other organic particulates and more specifically to the drying of coal fines using a polarized gas stream deployed in a continuous flow system.

Younger coal, such as sub-bituminous coal found in the Western United States and elsewhere, can have excessive amounts of moisture, defined generally as water content greater than fourteen percent (14%) by weight. This moisture is difficult to remove because it is "inherent" in the coal (i.e., retained in the molecular structure of the coal). Many surface coals gradually lose their moisture over a period of time and reach an equilibrium of about eight percent (8%) moisture content, which is well suited for commercial use.

Moisture content detracts from and reduces the BTU (British Thermal Unit) value of the coal. The moisture content of sub-bituminous coals has been a historical barrier to commercial exploitation of these coals. The water found in these coals has been shown to be as high as thirty-three percent (33%), virtually reducing the recoverable BTU's to half the expected levels for normal coal product. The following Table 1 illustrates the relationship.

TABLE NO. 1

| Moisture Content | Net BTU |
|---|---|
| 8% | 14,000 plus |
| 12% | 12,000 |
| 30% | 7,400 |
| 33-34% | 6,700 |

The adverse impact of moisture is not limited to the net combustion efficiency or other production related effects. When the water content reaches the levels that are found naturally in some coals, the economics of shipping the water itself becomes a drawback to the utilization of the coal product.

The presence of excess moisture in an otherwise usable coal product renders it commercially useless at worst and makes it barely marketable at low pricing at best. Similar problems exist with other organic products that contain excess moisture.

In the past, where it was determined to be economically feasible, attempts have been made to reduce the water content of coal with excess inherent moisture. Previous methods typically employed waste heat as the direct method for vaporizing the water held within the particle matrix. If waste or inexpensive heat was not available, it was generally found to be uneconomical to dry coal fines in this manner.

Other methods have been employed to reduce the moisture content of coal fines without resorting to heat. These have focused primarily on the ability of water to form partial solutions with low boiling organics such as the low molecular weight alcohols. Under these processes, the combined alcohol and water mix is allowed to be vaporized under ambient or low heat conditions. The recovery of the organic material is typically necessary to maintain economic practicability.

Another process utilizing a naphtha stream is known to be useful in removing water from adsorbents. In this process, the naphtha stream is a reluctant water vehicle and under quiescent conditioning, the water is separated from the vehicle. The process takes place under conditions of elevated temperature.

An object of the present invention is to provide an improved method and apparatus for removing moisture from coal that is efficient and does not require expensive heat or chemical reagents.

SUMMARY OF THE INVENTION

The present invention is a process by which water is removed from organic particles by a stream of a dry polarized gaseous media. The vapor pressure differential between the gaseous stream and the water and the electrical attraction between the gaseous and water particulates are the driving forces behind the transfer. In the preferred practice, the particulates are circulated downwardly through a coal drying chamber while the gaseous media stream flows in an upwardly swirling pattern that exposes the necessary amount of surface area of the particulates to the stream.

The gaseous media, in contacting the exposed particulates, has an uptake of moisture content from the particulates that are removed from the gaseous media after it exits from the chamber retaining the dried particulates. The gaseous media is subsequently filtered, compressed and then dried in a desiccant type gas dryer, where remaining water content is stripped to effective levels. The gaseous media is then routed back to the coal drying chamber housing the particulates for a repeat cycle.

The process described above operates on a continuous basis, with the particulates being fed through the coal drying chamber and discharged after appropriate contact with the stream has taken place. The gas dryer has a pair of desiccant tanks that are operated alternately, with the off-cycle tank being recharged while the other tank operates.

Other types of processes also may be employed to dry the gaseous media or further purify the gaseous media. These may be specifically determined for each type or grade of particulate being processed.

The coal is dried by transforming the coal to coal fines; polarizing the coal fines; partially discharging the charge from the coal fines to produce a residual charge on the water; and admixing the coal fines with a dry gaseous media of opposite or ground polarity in a coal drying chamber that swirls the gaseous media in a helical pattern until the coal fines are substantially dried.

The equipment used in the present invention combines design features that enhance the drying process. Such equipment includes the use of a unique drying chamber employing stepped baffle plates and air inlet nozzles arranged in helical configurations, with the air inlets being sequentially pulsed to produce a helical swirling gas flow pattern in the chamber. The chamber continuously receives and admixes the particulates and gaseous media in the swirling helical pattern, with the dried coal fines settling under gravity to the bottom of the chamber for collection and the moisture laden gas being removed from the chamber, dried, and then recycled. The inert gas Nitrogen is the gaseous media preferred in the present invention.

The desiccant means employed in the present invention includes a selection of adsorbents that compatibly remove the water content from the stream at high efficiency rates. The media used in the desiccant means may be pretreated with chemicals specially suited for the removal of impurities in the stream that result from contact with the particulates. A pair of desiccant tanks are used and recharged alternately so the process can be operated continuously.

The equipment and process of the present invention are preferably controlled by evaluation of the dew point condition of the gaseous stream. Thus the continuous nature of the process may be preserved by timely switching or sidestreaming of system components when stream conditions reach predetermined levels of saturation or fouling.

DETAILED DESCRIPTION OF PREFERRED EMBODIMENT

Figure 1:
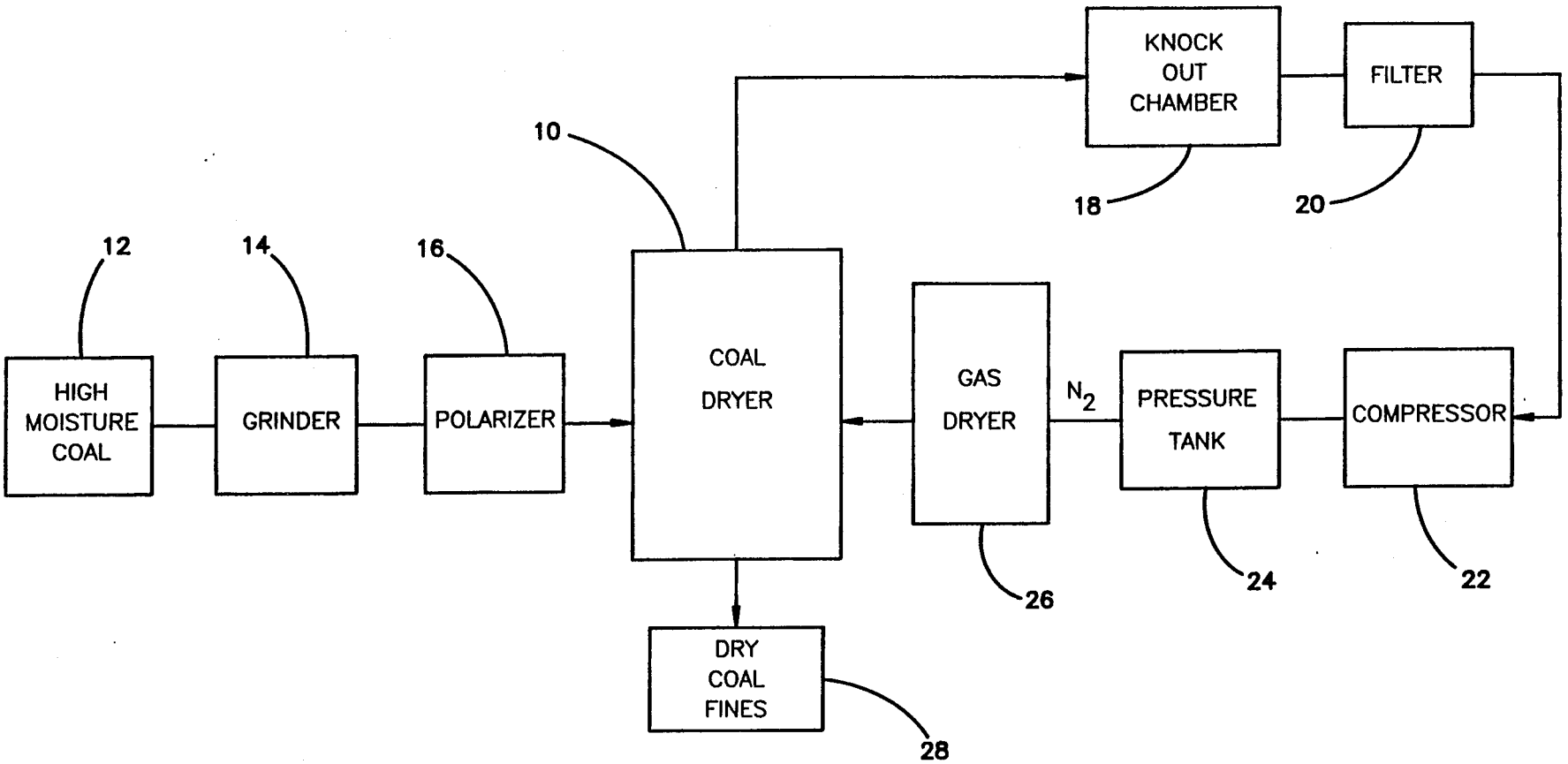
FIG. 1 is a schematic block diagram showing the operation of the process of the present invention.

Referring to the drawings, the general operation of the system is shown in FIG. 1. The central element of the equipment is a coal dryer 10 that is designed to remove the moisture, typically inherent moisture, from coal fines or other particulates having like properties as defined herein.

The process starts with the use of high moisture coal 12, which typically is sub-bituminous coal that is characteristic of the Western United States. The coal is transformed in a conventional grinder 14 to coal fines or particles, which are sized in the grinder to select particles desirably having a particle size of about 160 microns or less. Preferably the grinder index is set to select coal fines of about 104 microns or less. The selected coal fines are thereafter polarized with an electrical charge before being deposited in the coal dryer. The charge on the coal fines is partially discharged before they are deposited in the coal dryer by contact with an appropriate grounded surface or the like. Since the carbon components of the coal fines are relatively conductive, these constituents lose their charge rapidly in contact with the grounded surface. The water constituents, on the other hand, are less conductive and retain a residual amount of polarization sufficient to create a charge differential between the carbon and water components of the coal fines.

The coal fines are admixed with a dry gaseous media, preferably nitrogen, in the coal dryer in a helical flow pattern, with the coal fines being swirled around the coal dryer and gradually settling to the bottom of the coal dryer. The nitrogen gas is supplied from liquid nitrogen and is very dry. The dew point of the gas (i.e., the temperature at which water condenses from the gas) is −80° F. The electrical potential of the gas is either neutral (ground potential) or carries an opposite electrical charge from the water constituents of the coal fines. The nitrogen gas brought into intimate contact with the coal fines in the coal dryer adsorbs the moisture from the coal fines, probably by a combination of electrical attraction and difference in vapor pressure. The nitrogen gas then flows out of the top of the coal dryer for recycling and reuse. The nitrogen gas first passes through a water bath in a knock out chamber 18 and then through a filter 20, both steps being for the purpose of removing carbon from the gaseous media before it enters the compressor. The gas is then compressed to 110 to 125 psi in a compressor 22 and stored in a pressure tank 24. The pressurized gas is then passed through a desiccant type of gas dryer 26 and is thereafter recycled to the coal dryer for reuse. Dried coal fines 28 are removed from the bottom of the coal dryer and collected.

Figure 2:
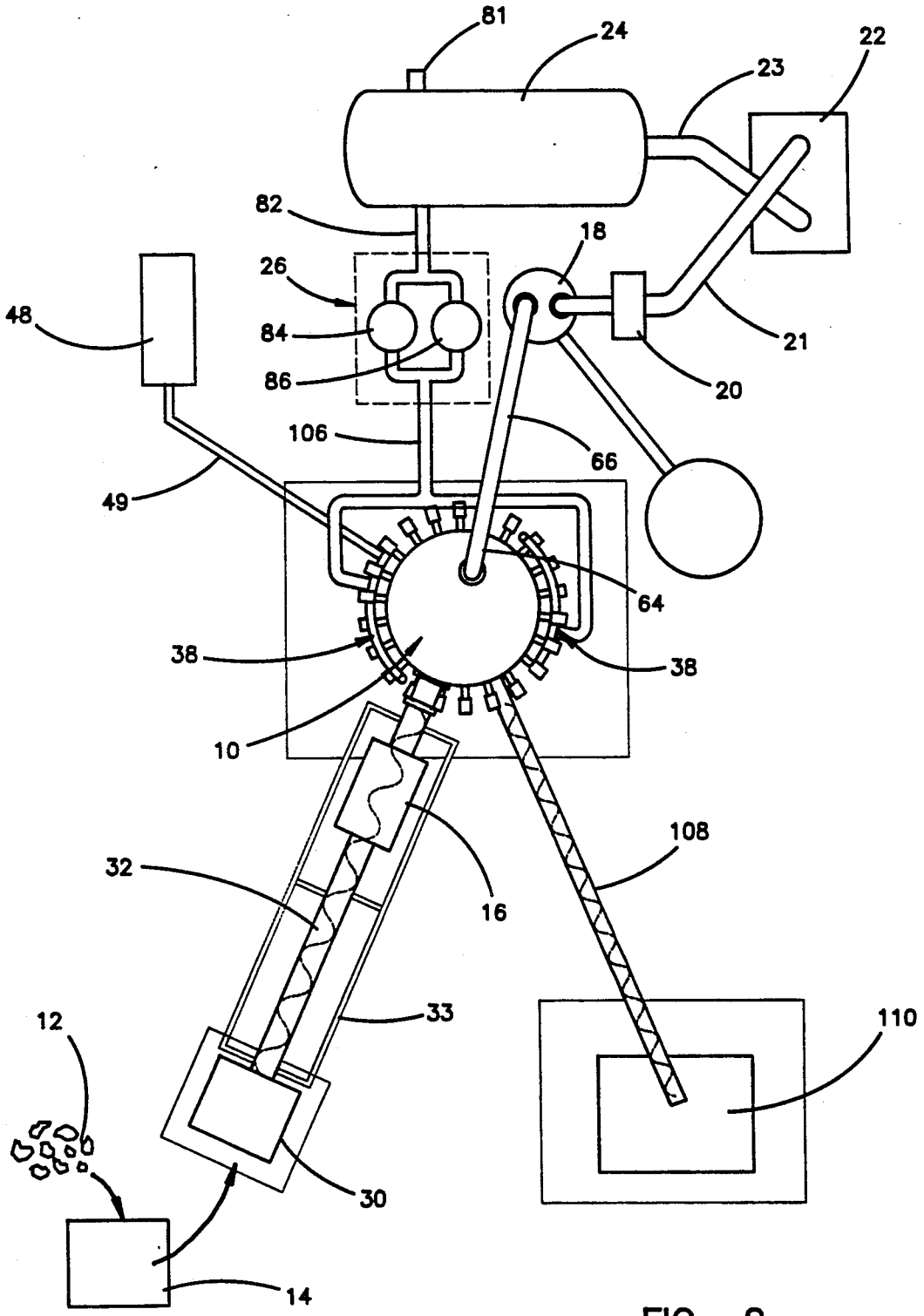
FIG. 2 is a plan view showing the equipment layout of the present invention.
Figure 3:
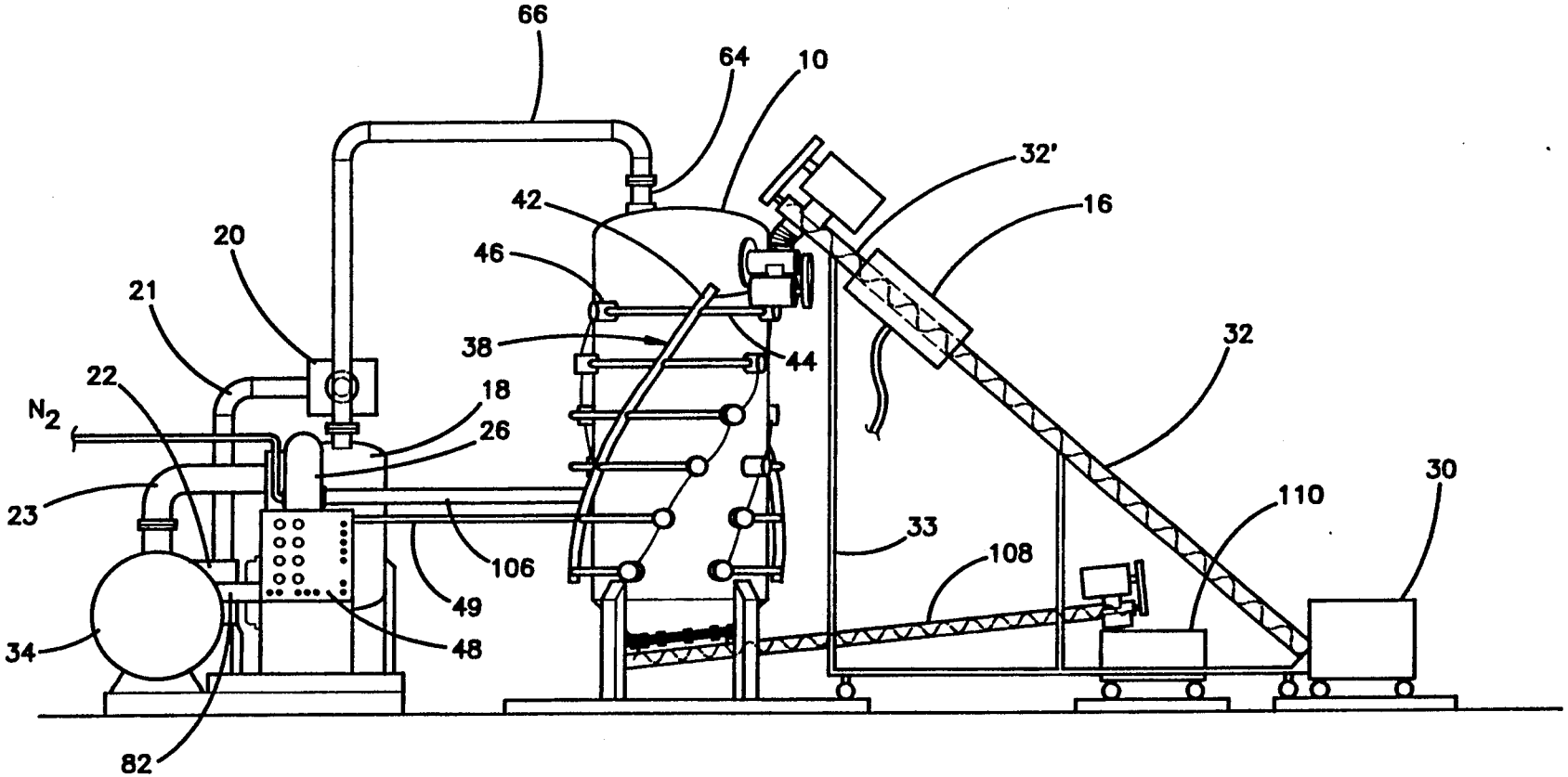
FIG. 3 is an elevational view showing the equipment of the present invention.
Figure 4:
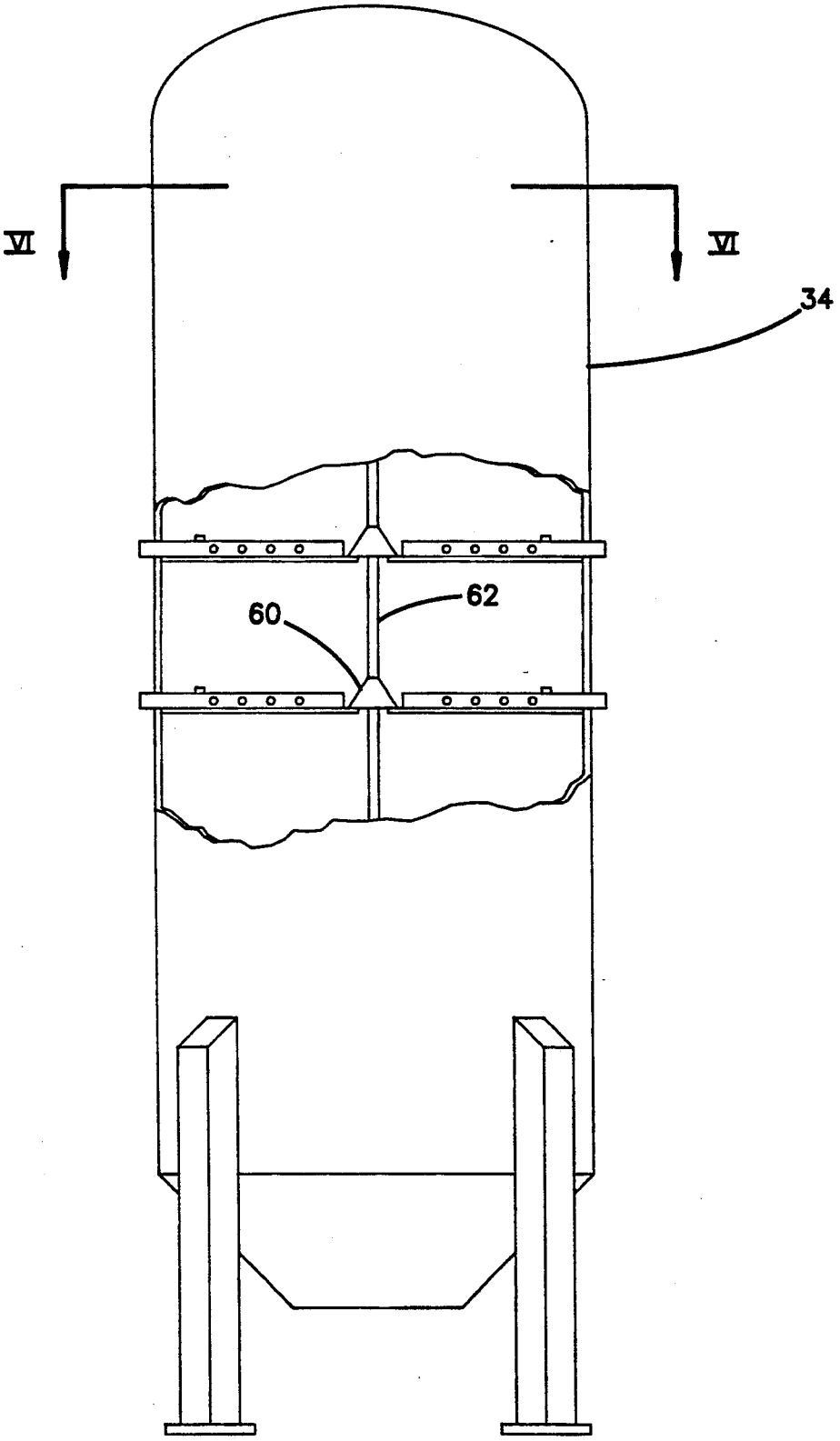
FIG. 4 is a side elevational view of the coal dryer of the present invention, with the manifold assemblies removed and the tank being partially broken away to show the internal plate arrangement.

The equipment employed in the present invention is shown assembled in FIGS. 2 and 3. Referring to FIG. 3, a covered coal hopper 30 containing coal fines is positioned adjacent coal dryer 10. Coal fines are transported to the coal dryer by means of an auger 32 that extends upwardly from the hopper to the top of the coal dryer. The auger consists of a helical screw mounted in a tubular sleeve which is supported on a rolling frame 33. The tubular sleeve is formed at least in part of a conductive metal which is grounded. The polarizer 16 comprises a pair of electrically charged plates or electrodes that are fitted in the side of the auger sleeve such that the coal fines come in contact with the electrodes as they pass through polarizer 16. The polarizer applies an electrical charge of at least 200 volts DC to the coal fines and desirably from 2 volts DC to 400 volts DC, depending on the amount of moisture in the coal (a larger polarizing voltage being required for coal with more moisture). In the preferred practice of the invention, a voltage of about 380 volts DC is used for coal with thirty-three percent (33%) moisture and a voltage of about 70 volts DC is used for coal with about twenty (20%) moisture.

The polarizer applies a charge to the coal fines a short distance before the coal fines are deposited in the coal dryer. This distance is about three (3) feet in the preferred embodiment of the invention. The portion of the auger sleeve, designated as 32', that is positioned between the polarizer and the coal dryer, is grounded so that as the coal fines tumble and come in contact with the sleeve, the electrical charge on at least the conductive constituents in the coal fines is discharged. The coal fines consist primarily of carbon and water, and the carbon is substantially more conductive than the water. The charge on the relatively conductive coal constituent is thus discharged faster than the charge on the relatively non-conductive water constituent of the coal fines. This is an important feature in the present invention, because a partial discharge of the charge on the coal fines leaves a charge differential between the carbon and water constituents in the coal fines. By the time the coal fines reach the coal drying chamber, the charge on the carbon is substantially discharged, while a substantial charge on the water remains.

Figure 5:
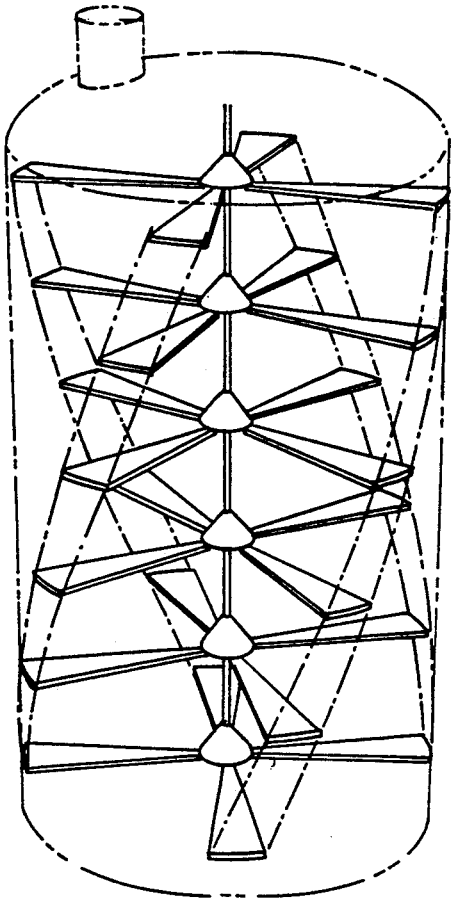
FIG. 5 is a pictorial perspective view showing the arrangement of the baffle plates in the coal dryer of the present invention.
Figure 6:
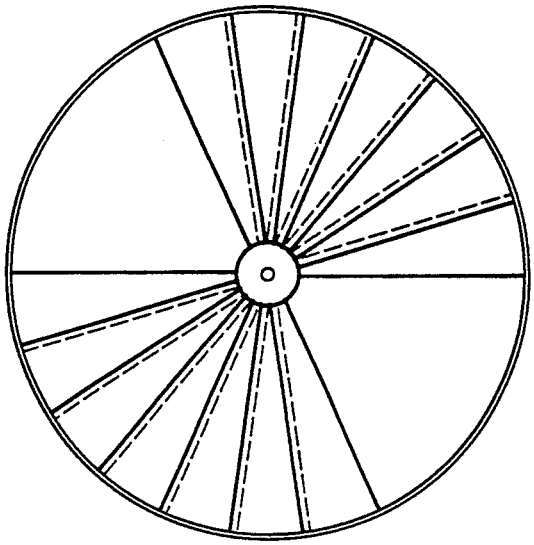
FIG. 6 is a sectional view taken along lines 6—6 of FIG. 4, showing only the plates and not the nozzles.

Referring to FIGS. 3–7, the coal dryer 10 comprises a vertically oriented cylindrical tank 34 having a hollow interior chamber. The interior of the tank is fitted with a plurality of wedge shaped baffle plates 36 mounted about the periphery of the chamber at predetermined axial positions along the chamber. The axially adjacent baffle plates are offset from one another so that they create a spiral staircase type of appearance, forming a generally helical stepped path downwardly through the chamber. As shown in FIGS. 5 and 6, each plate occupies a circumferential arc of about fifteen degrees (15°), with the plates overlapping by about five degrees (5°). Desirably, there are six (6) (FIG. 5) or seven (7) (FIG. 6) levels of plates in the coal drying chamber, with each level of plates having four (4) plates spaced symmetrically at ninety degree (90°) intervals around the interior of the chamber. This produces a set of four (4) helical paths downwardly through the chamber.

Figure 7:
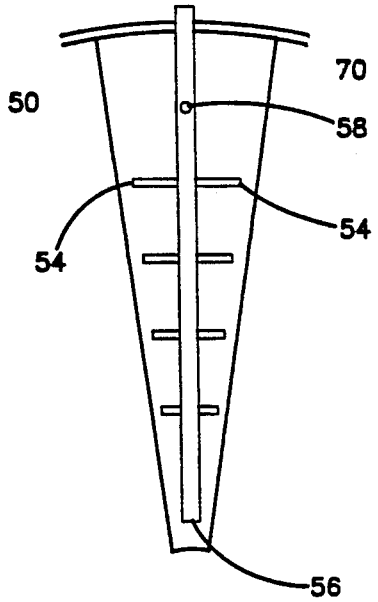
FIG. 7 is a top view of one baffle plate of the present invention, showing a gas outlet nozzle mounted thereon.

The gas is introduced into the gas dryer through a pair of manifold assemblies 38 positioned on opposite sides of the tank (FIG. 3). The manifold assemblies are connected to individual outlet nozzle mechanisms 40 that are mounted on individual baffle plates 36 (FIG. 7). Each manifold assembly includes a main trunk line 42 extending upwardly around the tank in a helical pattern, with branch arms 44 extending to the sides of the main trunk lines. Individual solenoids 46 in the branches control the transmission of pressurized air through the branches and into the nozzle assemblies inside the gas dryer chamber. An electrical control mechanism 48 (FIG. 2) connected to the coal dryer by cable 49 controls the sequencing and operation of the solenoids in a manner described below. When seven (7) levels of plates are employed, the control valves 46 for the plates 36' at the lowest level are manual valves that are kept open and not pulsed.

Nozzles 40, as shown in FIG. 7, are mounted on the baffle plates and include a radial leg 50 and transverse arms 52 extending circumferentially in each direction from the radial leg. Outlet orifices 54 are formed at the ends of arms 52 and a separate outlet orifice 56 is formed at the inner end of leg 50. Desirably the outlet orifices are about six hundredths of an inch (0.06") in diameter. As shown in the drawings, there are desirably four (4) sets of arms 52 in the preferred embodiment, with each set having a pair of arms extending in opposite circumferential directions.

As shown in FIG. 7, the plates in the preferred practice of the present invention, employing a tank almost sixteen (16) feet high, are spaced at equal intervals of twenty-three (23) inches along the vertical axis of the tank. The annular opening between the plates at the axis of the tank is covered by cone shaped members 60 which are integrally connected by rods 62.

Pressurized gaseous media is injected into the coal drying chamber in a predetermined sequence of gas pulses that are timed so that a swirling helical pattern of gas flow is formed through the interior of the chamber. The solenoids are timed by a conventional timing mechanism included in the electrical control mechanism 48 such that each successive plate in the four (4) plates at each level in the chamber are pulsed at intervals of 0.45 seconds, while each successive plate in the next lower level of plates along the spiral path is pulsed at an interval of 0.46 seconds with respect to the offset plate immediately above it. The duration of the pulses is desirably about 0.54 seconds per pulse.

The gas introduced into the interior of the gas drying chamber swirls in a helical pattern through the chamber and ultimately exits from the chamber through an outlet opening 64 at the top of the chamber (see FIG. 3). The whirling flow of the gases in a generally upward direction and the gradual settling of the coal fines in a downward direction while being entrained in a whirling flow path places the gas and particulate components in intimate association in the gas drying chamber and permits the transfer of moisture from the coal fines to the gaseous media. The difference in polarization of the gaseous media and the water component constituents of the coal fines enhances the transfer of moisture, as does the relative vapor pressure differential between the water constituent and the gaseous media. The use of inert nitrogen as a gas, which in its liquid form has a dew point of −80° F., ensures that the gas at the beginning of the process is very, very dry. Moisture picked up by the gas in the coal drying chamber is substantially removed by the gas drying mechanism of the present invention, such that the gas has a low dew point when it goes through the coal drying chamber and picks up a substantial amount of moisture from the coal fines.

Figure 9:
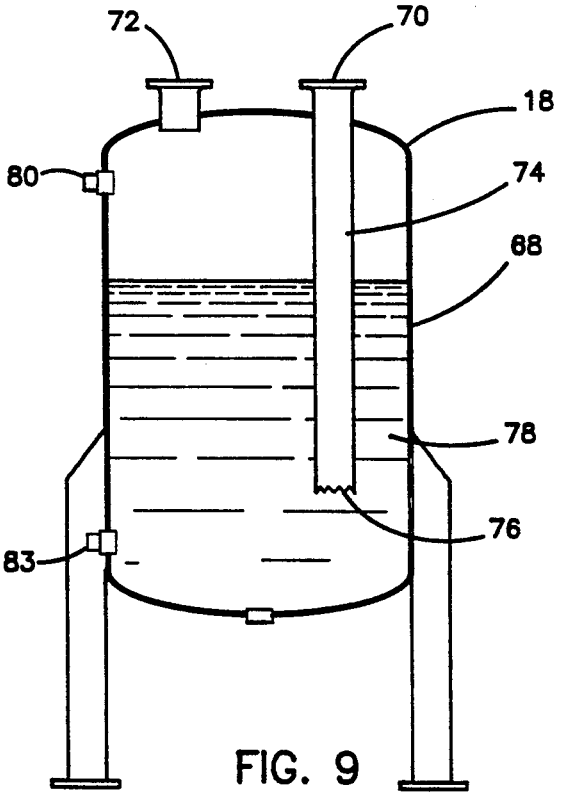
FIG. 9 is a side elevational view of the knock out chamber of the present invention.

Gas exiting the coal drying chamber at outlet 64 passes through a conduit 66 to the knock out chamber 18 (which is shown in FIG. 9). Knock out chamber 18 comprises a closed vessel 68 having an inlet 70 and an outlet 72. A dip tube 74 is connected to the inlet and extends downwardly to a lower end 76 at a lower portion of the tank. The tank is filled with water 78 to a level where it covers the lower end 76 of the inlet dip tube. Fittings 80 and 83 provide additional means for introducing and removing water from the tank.

Gas flowing through knock out tank 18 passes through the water in the tank before leaving exit 72, and the water serves to remove carbon particles from the exhaust gas before the gas is compressed in the compressor. After the gas leaves the knock out chamber, the gas passes through filter 20 for the purpose of further removing carbon particles from the exhaust gas before it is introduced into the compressor through conduit 21. The carbon-free gas then is compressed in compressor 22 and conveyed in conduit 23 for storage in a pressure tank 24. The compressor is a conventional 150 horsepower compressor, and the pressure tank is conventional. The compressor pressurizes the gas in the tank to a pressure of about 125 psi. Water that condenses in the pressure tank 24 is periodically drained from the pressure tank by means of a valve 81. Pressurized gas leaves the pressure tank by means of a conduit 82 that leads to two tanks 84 and 86 of the gas dryer 26. The gas dryer is conventional. The two tanks are filled with desiccant materials that the gas flows through, with the tanks being operated and recharged in alternate cycles.

Figure 8:
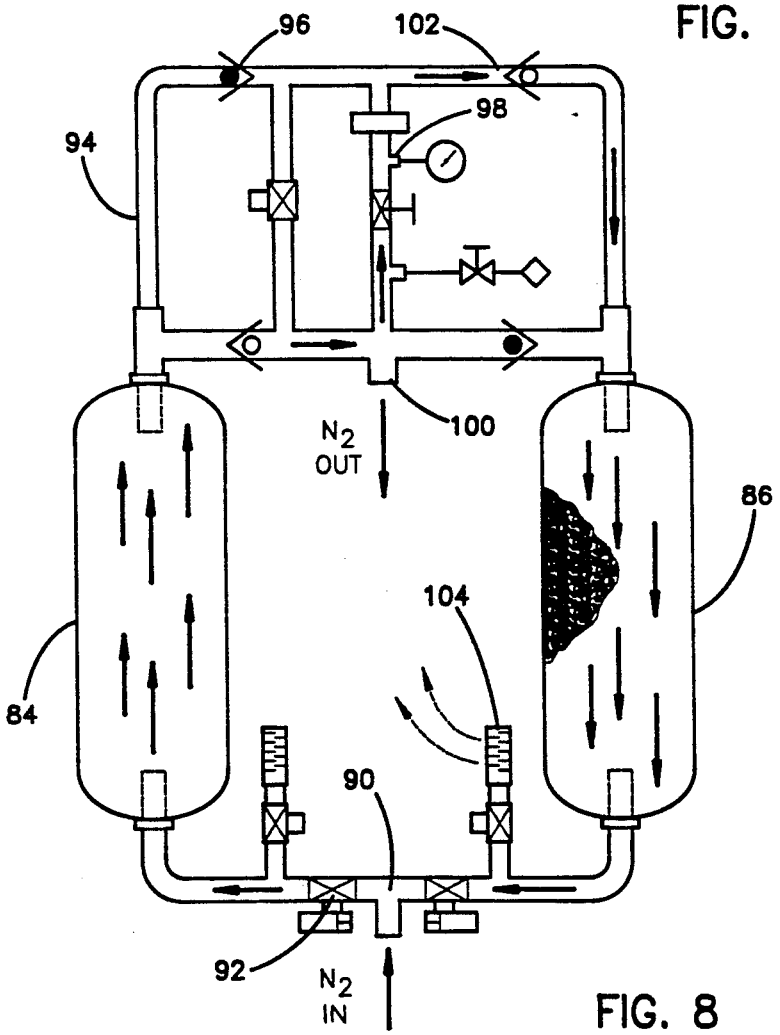
FIG. 8 is a schematic diagram of the gas dryer of the present invention.

A schematic flow diagram of the gas dryer is shown in FIG. 8. This illustrates how the gas dryer can operate in a continuous operation. As shown in FIG. 8, moisture laden gas enters the dryer through an inlet 90. A valve 92 directs the gas through desiccant tank 84, where the moisture is removed from the gas. The gas then goes through conduit 94, check valve 96 and then downwardly through conduit 97 to outlet 100. A small portion of the dry nitrogen (perhaps 10%) is routed through conduit 98 to conduit 102 and to desiccant tank 86. The dry air passes downwardly through this tank, withdrawing the moisture from the desiccant material in the tank. This gas is then purged through outlet 104. Alternatively, the gas may be run through a chiller or otherwise treated to remove the moisture from the gas and then recycled if it is desired to minimize gas losses, which may be the case in connection with nitrogen.

As can be seen, when tank 84 becomes saturated or otherwise fully charged with moisture and chemicals, the cycle is reversed by closing valve 92 and opening valve 99, so that tank 86 becomes operative and tank 84 goes off cycle for regeneration and recharging. By using a system of this type, the gas dryer can operate in a continuous system.

Dry gas exiting from the gas dryer then passes through conduit 106 to manifolds 38 leading to the coal dryer for recycling.

Coal fines that are collected at the bottom of the coal dryer chamber and are transported by an auger 108 to a suitable hopper 110 for collection.

In the apparatus of the present invention, the moisture content of sub-bituminous coal can be reduced efficiently and effectively in a continuous process without the introduction of heat and non-recoverable chemicals that reduce and sometimes destroy the efficiency of the process.

The present process can be used advantageously to lower the moisture content of coal fines to very low levels by using the process in conjunction with other processes. For example, the present invention can be used to reduce the moisture level of coal from as high as thirty-three percent (33%) to about twenty percent (20%) and a subsequent agglomeration process that operates most efficiently on coals with a moisture content of twenty percent (20%) or less can be used to produce pelletized coal having a very low moisture content.

The foregoing is intended to be illustrative of the present invention. Additional modifications may be made in the arrangements and details of construction of the embodiment disclosed herein without departing from the spirit and scope of the present invention, which is defined in the appended claims.

I claim:

1. A process for removing moisture from coal, wherein the coal includes relatively conductive constituents and relatively non-conductive water, the process comprising:

transforming the coal to coal fines for further treatment;

polarizing the coal fines with an electrical charge;

discharging the electrical charge from the coal fines until the electrical charge is substantially reduced in the relatively electrically conductive coal fine constituents, the electrical charge being discharged to a lesser degree from the relatively less conductive water particles, thus producing a charge or polarization differential between the water and the more conductive coal fine constituents;

removing water from the coal fines in a coal drying chamber by admixing the coal fines with a relatively dry gaseous media having a different state of electrical charge from the polarized water particles in the coal fines;

separating the moisture laden gaseous media from the coal fines; and collecting the dried coal fines.

2. A process according to claim 1 and further comprising:

removing the moisture from the gaseous media to return the gaseous media to a relatively dry state; and recycling the dried gaseous media for removing water from more coal fines.

3. A process according to claim 1, wherein the coal fines selected for further treatment have particle sizes of about 160 microns or less and are charged with a voltage of at least two (2) volts DC relative to a selected ground voltage employed for the gaseous media.

4. A process according to claim 3, wherein the coal fines are charged with a relative voltage of about two (2) to four hundred (400) volts DC.

5. A process according to claim 4, wherein the coal fines are charged with a relative voltage of about seventy (70) to three hundred eighty (380) volts DC.

6. A process according to claim 1, wherein the coal fines are dried in a drying chamber wherein the gaseous media is caused to swirl in a helical pattern in the chamber and exit at the top of the chamber, while the coal fines are introduced in an upper portion of the chamber and are swirled in the chamber by the gaseous media as the gaseous media absorbs the moisture from the coal fines, the coal fines gradually settling downward in the chamber under the influence of gravity, the dried coal fines being removed from a lower portion of the chamber.

7. A process according to claim 6, wherein the drying chamber comprises a hollow, vertically oriented, cylindrical chamber having a series of stepped radial baffle plates positioned at spaced positions along the chamber so as to create a stepped helical path having the general configuration of a spiral staircase, the gaseous media being introduced into the chamber under pressure through outlet nozzles adjacent different plates, the gaseous media being discharged at stepped intervals in timed pulses that sequentially follow the spiral path of the plates, the gaseous pulses generating a helical swirl of gaseous media in the chamber and urging the coal fines to swirl with the gaseous media and follow a helical path through the chamber.

8. A process according to claim 7, wherein there are a predetermined plurality of plates positioned around the cylinder at each axial position along the cylinder so as to create a plurality of interlocking helical paths along the chambers.

9. A process according to claim 8, wherein there are four (4) plates at each axial position along the chamber, the plates being symmetrically spaced around the circumference of the chamber, each plate extending through an arc of about fifteen degrees (15°), the plates in successive positions along the chamber overlapping by about five degrees (5°).

10. A process according to claim 7, wherein the outlet nozzles extend from outer ends at the wall of the chamber radially inwardly along the plates to inner end positions toward the center of the chamber, the nozzles having outlet orifices positioned between the inner and outer ends of the nozzles that direct gaseous media in a circumferential direction.

11. A process according to claim 10, wherein the nozzles direct gaseous media simultaneously from both sides of the nozzles in opposite circumferential directions.

12. A process according to claim 11, wherein the nozzles further direct gaseous media in a radially inward direction from the inner end of the nozzles.

13. A process according to claim 8, wherein the gaseous media is discharged in pulses by a plurality of electrically operated control valves that are sequentially actuated.

14. A process according to claim 13, wherein the control valves are solenoid valves.

15. A process according to claim 11, wherein the control valves are pulsed for a duration of about 0.54 seconds, the nozzles on the plates at each axial position being sequentially pulsed at intervals of 0.45 seconds, the nozzles being sequentially pulsed at each plate forming the axial steps in the helical path of the plates at intervals of 0.46 seconds.

16. A process according to claim 2, wherein the gaseous media is substantially inert and comprises primarily nitrogen gas.

17. A process according to claim 1, wherein after the moisture laden gaseous media is separated from the coal fines in the coal drying chamber, the gaseous media is filtered to remove remaining coal fines from the gaseous media, then the gaseous media is compressed and passed through a gas dryer to remove the moisture from the gaseous media, the dried gas then being returned to the coal drying chamber to remove moisture from more coal.

18. A process according to claim 17, wherein the gas dryer comprises a desiccant dryer.

19. A process according to claim 2, wherein the process is performed in a continuing operation, with coal fines being continually polarized and fed to the coal drying chamber and gaseous media being continuously recycled through the coal drying chamber and gas dryer so as to produce a continuous output of dried coal fines.

20. A process according to claim 18, wherein the desiccant dryer for the gaseous media comprises a pair of dryer tanks filled with desiccant materials through which the moisture laden gaseous media is circulated, the desiccant dryer being provided with automatic control means that circulates moisture laden gaseous media alternately through the two tanks and uses dry gas from one tank to recharge the other tank when it is off cycle.

21. Drying equipment for removing moisture from coal wherein the coal includes relatively conductive constituents and relatively non-conductive water, the equipment comprising:

coal grinder means for transforming the coal to coal fines for further treatment;

polarizing means for polarizing the coal fines with an electrical charge;

discharge means for discharging the electrical charge from the coal fines until the electrical charge is substantially reduced in the relatively electrically conductive coal fine constituents, the electrical charge being discharged to a lesser degree from the relatively less conductive water particles, thus producing a charge or polarization differential between the water and the more conductive coal fine constituents;

coal dryer means for removing water from the coal fines by admixing the coal fines with a relatively dry gaseous media having a different state of electrical charge from the polarized water particles in the coal fines;

means for separating the moisture laden gaseous media from the coal fines; and means for collecting the dried coal fines.

22. Equipment according to claim 21 and further comprising:

gas dryer means for removing the moisture from the gaseous media to return the gaseous media to a relatively dry state; and means for recycling the dried gaseous media for removing water from more coal fines.

23. Equipment according to claim 21, wherein:

the equipment include means for selecting coal fines for further treatment having particle sizes of about 160 microns or less; and the polarizing means applies a voltage of at least two (2) volts DC to the coal fines.

24. Equipment according to claim 23, wherein the polarizing means applies a voltage of at least about seventy (70) volts DC to the coal fines.

25. Equipment according to claim 24, wherein the polarizing means applies a voltage of about seventy (70) to four hundred (400) volts DC to the coal fines relative to the voltage potential of the gaseous media.

26. Equipment according to claim 21, wherein the coal dryer means include a drying chamber wherein the gaseous media is caused to swirl in a helical pattern in the chamber and exit at the top of the chamber, while the coal fines are introduced in an upper portion of the chamber and are swirled in the chamber by the gaseous media as the gaseous media absorbs the moisture from the coal fines, the coal fines gradually settling downward in the chamber under the influence of gravity, the dried coal fines being collected in a lower portion of the chamber.

27. Equipment according to claim 26, wherein the drying chamber comprises a hollow, vertically oriented, cylindrical chamber having a series of stepped radial baffle plates positioned at spaced positions along the chamber so as to create a stepped helical path having the general configuration of a spiral staircase, the gaseous media being introduced into the chamber under pressure through outlet nozzles adjacent different plates, the gaseous media being discharged by electrically operated control valves connected to the outlet nozzles, the control valves being spaced at stepped intervals and timed to produce timed pulses that sequentially follow the spiral path of the plates, the gaseous pulses generating a helical swirl of gaseous media in the chamber and urging the coal fines to swirl with the gaseous media and follow a helical path through the chamber.

28. Equipment according to claim 27, wherein there are a predetermined plurality of plates positioned around the cylinder at each axial position along the cylinder so as to create a plurality of interlocking helical paths along the chambers.

29. Equipment according to claim 28, wherein there are four (4) plates at each axial position along the chamber, the plates being symmetrically spaced around the circumference of the chamber, each plate extending through an arc of about fifteen degrees (15°), the plates in successive positions along the chamber overlapping by about five degrees (5°).

30. Equipment according to claim 28, wherein the outlet nozzles extend from outer ends at the wall of the chamber radially inwardly along the plates to inner end positions toward the center of the chamber, the nozzles having outlet orifices positioned between the inner and outer ends of the nozzles that direct gaseous media in a circumferential direction.

31. Equipment according to claim 30, wherein the nozzles direct gaseous media simultaneously from both sides of the nozzles in opposite circumferential directions.

32. Equipment according to claim 31, wherein the nozzles further direct gaseous media in a radially inward direction from the inner end of the nozzles.

33. Equipment according to claim 29, wherein the control valves comprises solenoid valves.

34. Equipment according to claim 27, wherein the control valves generate gas pulses having a duration of about 0.54 seconds, the nozzles on the plates at each axial position being sequentially pulsed at intervals of 0.45 seconds, the nozzles being sequentially pulsed at each plate forming the axial steps in the helical path of the plates at intervals of 0.46 seconds.

35. Equipment according to claim 22, wherein the gaseous media is substantially inert and comprises primarily nitrogen gas.

36. Equipment according t claim 21 and further comprising:

filter means for removing coal fines from the gaseous media after the gaseous media containing the removed moisture is removed from the coal dryer;

compressor means for pressurizing the gaseous media;

a gas dryer means for removing the moisture from the gaseous media; and a means for returning the dried gas to the coal dryer means to remove moisture from more coal.

37. Equipment according to claim 36, wherein the gas dryer comprises a desiccant dryer.

38. Equipment according to claim 36 and further comprising means for continuously supplying coal fines to the coal dryer means.

39. Equipment according to claim 37, wherein the desiccant dryer for the gaseous media comprises a pair of dryer tanks filled with desiccant materials through which the moisture laden gaseous media is circulated, the desiccant dryer having automatic control means that circulates moisture laden gaseous media alternately through the two tanks and uses dry gas from one tank to recharge the other tank when it is off cycle.

* * * * *